US006196544B1

(12) United States Patent
Rachofsky

(10) Patent No.: US 6,196,544 B1
(45) Date of Patent: Mar. 6, 2001

(54) THREE-DIMENSIONAL PUZZLE

(76) Inventor: Morton Rachofsky, 5511 Stonegate Rd., Dallas, TX (US) 75209-3521

( * ) Notice: Subject to any disclaimer, the term of this patent is extended or adjusted under 35 U.S.C. 154(b) by 0 days.

(21) Appl. No.: 09/272,216

(22) Filed: Mar. 18, 1999

(51) Int. Cl.[7] ..... A63F 9/12
(52) U.S. Cl. ..... 273/157 R
(58) Field of Search ..... 273/153 R, 157, 273/153 G, 160, 275

(56) References Cited

U.S. PATENT DOCUMENTS

| | | | | |
|---|---|---|---|---|
| 191,167 | * | 5/1877 | Mueller | 273/157 R |
| 477,633 | * | 6/1892 | Barringer | 273/157 R |
| 3,302,311 | * | 2/1967 | Israel | 273/157 R |
| 3,546,792 | * | 12/1970 | Sherman | 273/160 |
| 3,565,443 | * | 2/1971 | Klein | 273/157 R |
| 3,638,949 | * | 2/1972 | Thompson | 273/157 R |
| 3,679,213 | | 7/1972 | Moss | 273/156 |
| 4,037,846 | | 7/1977 | Zeeman | 273/157 R |
| 4,257,609 | * | 3/1981 | Squibbs | 273/157 R |
| 4,345,762 | | 8/1982 | Lebelson | 273/157 R |
| 4,667,962 | | 5/1987 | Ishiyama | 273/157 R |
| 5,407,201 | * | 4/1995 | Whitehurst | 273/157 R |

OTHER PUBLICATIONS

*Scientific American*, "A Quarter–Century of Recreational Mathematics" by Martin Gardner, Aug. 1998, pp. 70–71.
Puzzle article; title and author unknown; pp. 42–49; date unknown.

* cited by examiner

*Primary Examiner*—Steven Wong
(74) *Attorney, Agent, or Firm*—Sidley & Austin

(57) ABSTRACT

A puzzle includes a set of three-dimensional puzzle pieces (52*a–d*) having at least two different indicia (W, Y) applied on the external surfaces to define a pattern of continuous stripes. The puzzle pieces can have the shape of a Z-polycube (20) formed from four unit cubes. The external shape and size of each puzzle piece in the set is identical, however, the indicia are applied in a different pattern on each puzzle piece in the set. The puzzle pieces in the set are juxtaposable to form a secondary object (54) having a second external shape such that the indicia visible on the external surface of secondary object defines a pattern of continuous stripes. A plurality of secondary puzzle modules (54, 56) can be juxtaposed to form a tertiary object (80) wherein the surface indicia visible on the external surface of tertiary object still form a pattern of continuous stripes. When the pieces and puzzle modules of the puzzle are correctly juxtaposed, the structure forms a sculpture with a desirable appearance.

27 Claims, 9 Drawing Sheets

FIG. 11b FIG. 11h FIG. 11e FIG. 11a FIG. 11f FIG. 11k FIG. 11g FIG. 11l FIG. 11c FIG. 11i FIG. 11d FIG. 11j FIG. 11n FIG. 11t FIG. 11q FIG. 11m FIG. 11r FIG. 11w FIG. 11s FIG. 11x FIG. 11o FIG. 11u FIG. 11p FIG. 11v

THREE-DIMENSIONAL PUZZLE

TECHNICAL FIELD OF THE INVENTION

This invention relates generally to three-dimensional puzzles of the type comprising a plurality of three-dimensional pieces which can be juxtaposed to form one or more new objects having specific external characteristics. In one aspect, it relates to a puzzle consisting of identically shaped pieces decorated with a pattern of continuous stripes.

BACKGROUND OF THE INVENTION

Many types of three-dimensional puzzles are known. A common type comprises a plurality of three-dimensional pieces which can be arranged in juxtaposition to form one or more new objects having specific desirable characteristics. These desirable characteristics are also known as the goal of the puzzle. In some puzzles, the goal can be the formation of one or more objects having a pre-determined three-dimensional shape; in other puzzles the goal can be the formation of one or more objects having indicia (e.g., colors, letters, icons, patterns and the like) on the external surface which are arranged to form a predetermined pattern; and in still other puzzles, the goal can be the formation of new objects having a specific combination of three-dimensional shape and arrangement of indicia on the external surface.

New puzzles are constantly needed to satisfy the recreational and intellectual demands of users. Puzzles which consist of identically shaped pieces are particularly challenging (and thus desirable) as they allow a greater number of possible assembly configurations, thus increasing the intellectual challenge to the user trying to achieve a specific goal.

To prevent the user from losing interest in the puzzle after finding a solution to one goal, it is desirable to make a puzzle having multiple goals. The multiple goals can be independent, i.e., where each goal is achievable in the alternative, or they can be dependent, i.e., where some goals are achievable only after a solution to a previous goal has been found. For example, a first goal can be to arrange the puzzle pieces to produce two or more secondary objects each having specific goal characteristics. A second, dependent goal, can be to arrange the completed secondary objects to form a tertiary object having its own goal characteristics.

In addition to presenting an intellectual challenge to the user with regard to finding solutions for one or more pre-determined goals, it is desirable for a three-dimensional puzzle to have one or more goal configurations which are aesthetically pleasing. This allows the puzzle to be displayed in the home or office when not being used. A three-dimensional puzzle which forms a sculpture as at least one goal is thus desirable.

SUMMARY OF THE INVENTION

One aspect of the current invention comprises a three-dimensional puzzle including a plurality of puzzle pieces, each puzzle piece being of identical size and shape to the others and having at least two different indicia applied on the external surfaces thereof to define a pattern of visibly continuous stripes thereon. The puzzle pieces are juxtaposable to form a secondary puzzle module having at least two of the different indicia visible on the external surfaces thereof defining a pattern of visibly continuous stripes thereon. In other embodiments of the invention, the secondary puzzle module has a greater number of different indicia visible on the external surface. In yet another embodiment of the invention the puzzle pieces are polycubes. In a still further embodiment of the invention the puzzle pieces have the shape of a Z-polycube formed from four unit cubes. In a still further embodiment of the invention the puzzle consists of four puzzle pieces.

In another embodiment of the invention, the secondary puzzle module can be a polycube solid having orthogonal exterior dimensions of three units by three units by two units and forming a passage therethrough having orthogonal dimensions of one unit by one unit by two units. In a further embodiment of the invention, the pattern of visibly continuous stripes on the secondary module includes stripes on the exposed surface of the passage. In a still further embodiment of the invention, the pattern of visibly continuous stripes on the secondary module consists of six stripes running diagonally across each plane surface having exterior dimensions of three units by three units and five stripes running diagonally across each plane surface having exterior dimensions of three units by two units.

Another aspect of the current invention comprises a three-dimensional puzzle consisting of four puzzle pieces, each puzzle piece being of an identical size, having the shape of a Z-polycube formed from four unit cubes and having at least two different indicia applied on the external surfaces thereof to define a pattern of visibly continuous stripes thereon. The puzzle pieces are juxtaposable to form a secondary puzzle module having the shape of a polycube solid with orthogonal exterior dimensions of three units by three units by two units and forming a passage therethrough having orthogonal dimensions of one unit, one unit, and two units and having at least two of said different indicia visible on the external surfaces thereof defining a pattern of visibly continuous stripes thereon. In a further embodiment, the pattern of visibly continuous stripes on the secondary module can include stripes on the exposed surface of said passage. In a still further embodiment, each of the different indicia is an indicia selected from the group consisting of surface colors, surface textures, letters formed on the surface, numbers formed on the surface, symbols formed on the surface, and icons formed on the surface. In still another embodiment, the pattern of visibly continuous stripe on the secondary module consists of six stripes running diagonally across each plane surface having exterior dimensions of three units by three units and five stripes running diagonally across each plane surface having exterior dimensions of three units by two units. Further embodiments specify the different indicia defining the pattern of visibly continuous stripes on the secondary puzzle module, for example, two, three, four, five, six and at least seven contrasting surface colors.

Still another aspect of the current invention comprises a three-dimensional puzzle including at least two sets of puzzle pieces. Each set has a like number of puzzle pieces, all puzzle pieces in all sets are of identical size and shape and have at least two different indicia applied on the external surfaces thereof to define a pattern of continuous stripes thereon, the pattern of continuous stripes being different on each said piece of all sets. The puzzle pieces of each set are juxtaposable to form a secondary puzzle module having at least two different indicia visible on the external surfaces thereof defining a pattern of continuous stripes thereon, and the secondary puzzle modules are juxtaposable to define a tertiary puzzle module having at least two different indicia visible on the external surfaces thereof forming a pattern of continuous stripes thereon. In another embodiment, the puzzle comprises at least four sets of puzzle pieces having at least four different indicia visible on the external surfaces of the puzzle pieces, the secondary puzzle modules, and the tertiary puzzle module. In yet another embodiment, the puzzle comprises at least five sets of puzzle pieces having at least five different indicia visible on the external surfaces of the puzzle pieces, the secondary puzzle modules, and the tertiary puzzle module. In a further embodiment, the puzzle pieces are polycubes. In yet another embodiment, each set consists of four puzzle pieces, each puzzle piece being in the shape of a Z-polycube formed from four unit cubes.

In another embodiment, each secondary puzzle module has a polycube shape with orthogonal exterior dimensions of three units by three units by two units and forms a passage therethrough having orthogonal interior dimensions of one unit by one unit by and two units. In still another embodiment, the tertiary puzzle module comprises at least two secondary puzzle modules juxtaposed at sides each having dimensions of three units by three units. In a still further embodiment, the tertiary puzzle module comprises at least two said secondary puzzle modules juxtaposed at sides each having dimensions of three units by two units.

BRIEF DESCRIPTION OF THE DRAWINGS

A more complete understanding of the present invention and the advantages thereof will be apparent from the following detailed description when taken in conjunction with the accompanying drawings in which.

DETAILED DESCRIPTION

Figure 1:
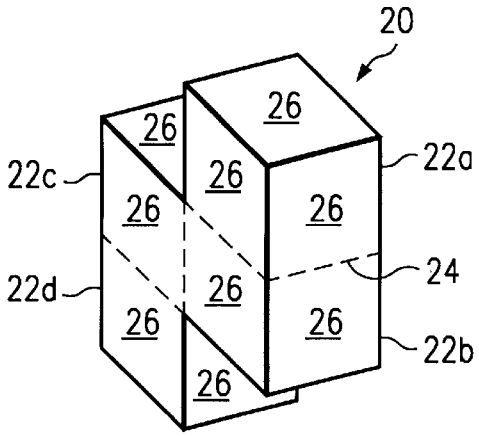
FIG. 1 is a perspective view of a Z-polycube puzzle piece with broken lines indicating the constituent unit cubes.

Referring now to the drawings, wherein like reference numbers are used to designate like elements throughout the various views, several embodiments of the current invention are further described. Referring now specifically to FIG. 1, shown therein is a three-dimensional object 20 known as a Z-polycube, the shape of which can be used for the pieces of the current invention. In general, a polycube is a three-dimensional shape created by joining identical cubes, known as unit cubes, at their faces. For purposes of this application, the term "unit", unless otherwise expressly indicated, denotes a distance equal to the length of one side of a unit cube. Polycube objects may comprise any number of unit cubes joined in any type of arrangement. The Z-polycube puzzle piece 20 is formed from four unit cubes 22*a*–*d* (denoted by geometric boundary lines 24 in FIG. 1) arranged in the form of a stylized letter "Z". Note that the Z-polycube puzzle piece 20 need not actually be formed from discrete unit cubes, rather it need only have the dimensions of an object formed from unit cubes joined on their faces. Z-polycube puzzle pieces can be manufactured from any solid material suitable for puzzles and toys, including wood, plastic, metal, cardboard and paper, using manufacturing methods known in the art.

While the geometric boundaries 24 between the unit cubes 22*a–d* comprising a Z-polycube puzzle piece 20 need not be visible on the actual piece, the external surface of the Z-polycube puzzle piece 20 can nonetheless be divided along the geometric locations of the boundaries 24 into eighteen square-shaped regions known as faces 26, each face 26 corresponding to an exposed face of one of the constituent unit cubes 22*a–d*. For purposes of illustration, the faces 26 are each individually denoted in FIG. 1, however, it will be readily understood that the location of these square faces can be determined on the external surface of all polycube puzzle pieces and other structures made from polycubes whether or not the faces are visibly denoted.

Figure 2:
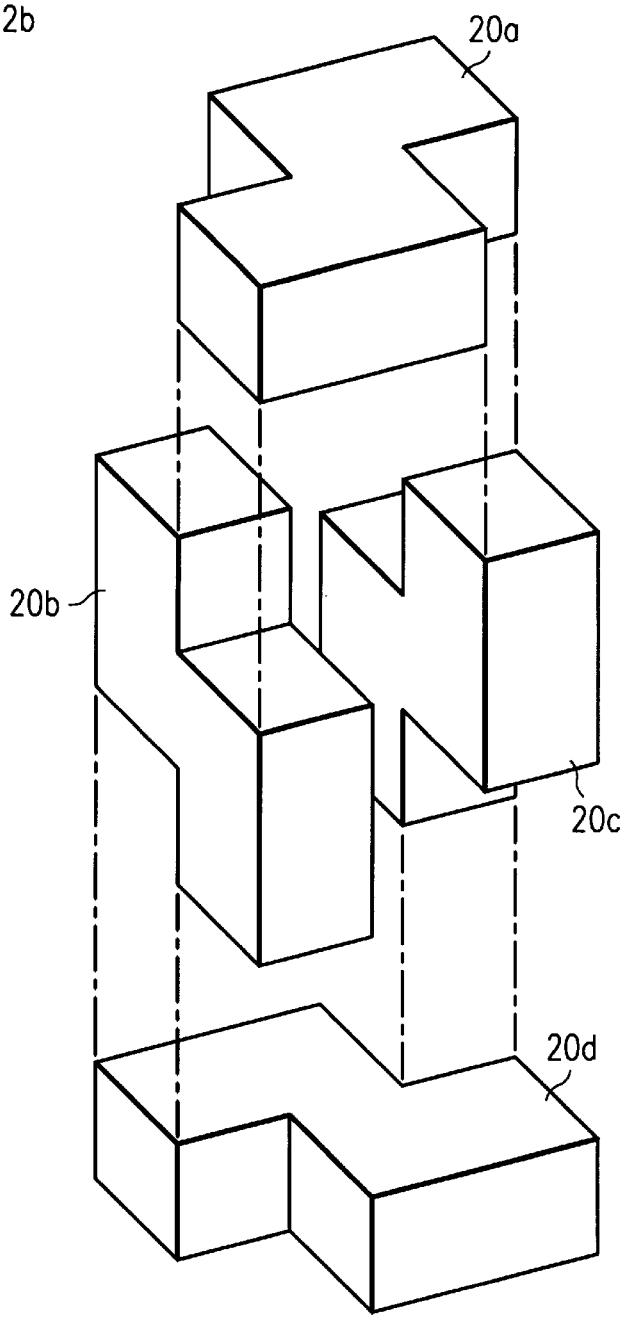
FIG. 2 is an exploded perspective view showing how four identical Z-polycube puzzle pieces can be juxtaposed to form a secondary puzzle module.
Figure 3:
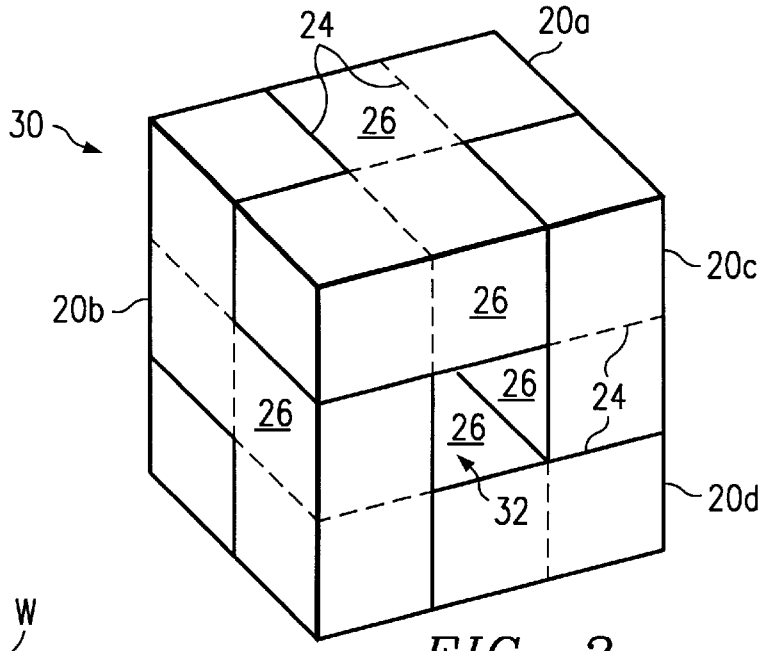
FIG. 3 is a perspective view of an assembled secondary puzzle module formed from four identical Z-polycube puzzle pieces juxtaposed as shown in FIG. 2.

Referring now to FIGS. 2–3, a set of four identical Z-polycube puzzle pieces 20*a–d* can be juxtaposed as shown in FIG. 2 to form a secondary puzzle module 30 as shown in FIG. 3. The secondary puzzle module 30 has the form of a polycube solid having external orthogonal dimensions of 3×3×2 units and forming a rectangular passage or hole 32 with orthogonal dimensions of 1×1×2 units which passes through the center of the 3×3 unit sides, i.e., entirely through the module 30. As shown in FIG. 3, some of the geometric boundaries 24 between the unit cubes of the secondary puzzle module 30 are actual edges between the different Z-polycube puzzle pieces 20 *a–d*, for example, the boundaries 24 denoted using solid lines, while other boundaries 24 are merely geometric constructs based upon the dimension of the puzzle module, for example, the boundaries 24 denoted using broken lines (which need not be visible on the actual puzzle module).

As with the Z-polycube puzzle pieces 20 previously described, the external surface of the secondary puzzle module 30 can be divided along the geometric boundaries 24 into a plurality of square-shaped faces 26, each face 26 corresponding to an exposed face of one of the constituent unit cubes. For purposes of clarity of illustration, all of the faces 26 will not be individually denoted in FIG. 3 or subsequent figures, rather only representative faces 26 will be denoted. It will further be appreciated that the faces 26 on the secondary puzzle module include the eight exposed faces which line the hole 32 formed through the puzzle module. For purposes of this application, the faces along the hole 32 are considered part of the external surface of the puzzle module 30.

Figure 4:
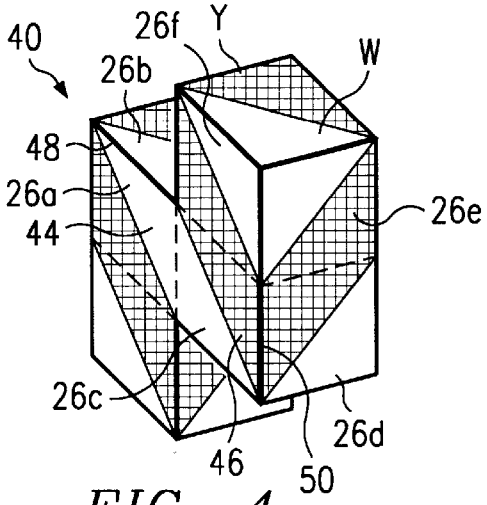
FIG. 4 is a perspective view of a Z-polycube, geometrically similar to that shown in FIG. 1, having two different surface indicia to define a pattern of continuous stripes over the external surface.

Referring now to FIG. 4, shown is a decorated Z-polycube puzzle piece 40 which is geometrically identical to the Z-polycube puzzle piece 20 shown in FIG. 1 and previously described; however, two different indicia (denoted using reference characters W and Y) have been applied to the exterior surface to define a pattern of continuous stripes. For purposes of this application, the term "indicia" is used to denote any distinctive mark or other surface characteristic which allows one area of a surface to be visibly distinguished from an adjacent area including, for example, surface color and surface texture, as well as letters, numbers, symbols, or icons printed or formed on the surface. Further for purposes of this application, the term "continuous stripe" is used to denote a stripe which is defined by like indicia and which is visually perceived to run straight across plane surfaces and boundaries between coplanar surfaces on the puzzle pieces and which wraps or continues around orthogonal edges of the puzzle pieces, i.e., for any point on an edge defined by the meeting of orthogonal surfaces, like indicia characterize the stripes directly adjacent to such point on each side of the edge.

In FIG. 4, the different indicia on the surface of the Z-polycube puzzle piece 40 are illustrated using different drawing symbols, denoted by the reference letters W and Y, and the continuous stripes, e.g., stripes 44 and 46, run diagonally (i.e., along the diagonals of the square faces) across the plane surfaces of the Z-polycube puzzle piece 40, wrapping over each edge where orthogonal surfaces meet. For example, the W-type stripe 44 runs across plane faces 26*c* and 26*a* and then wraps around edge 48 from face 26*a* to face 26*b*, and the Y-type stripe 46 runs across plane faces 26*f* and 26*c*, then wraps around edge 50 from face 26*c* to face 26*d* and then runs across plane faces 26*d* and 26*e*. It will be appreciated that the pattern of continuous stripes on the decorated Z-polycube puzzle piece 40 extends to the external surface areas not visible in FIG. 4, as will be further discussed below.

It will be appreciated that whenever a continuous stripe wraps around an orthogonal edge from a first plane surface to a second plane surface, the stripe can continue in one of several directions on the second plane surface, regardless of its direction on the first plane surface. By selecting different wrap directions at some edges, many different patterns of continuous stripes can be created from the same number of indicia on geometrically identical Z-polycube puzzle pieces, it being understood that the identity of the pattern on a particular Z-polycube puzzle piece is determined from a consideration of all external surfaces.

It will also be appreciated that an indicia forming a continuous stripe need not necessarily be continuous itself provided a continuous stripe can be visibly perceived from the regions to which the indicia is applied. For example, an indicia can consist of a plurality of small discrete dots having a color which contrasts with the underlying surface. While not actually continuous, such dots are visually perceived as forming a tinted area which can define a stripe. Similarly, an indicia can consist of a plurality of discrete letters or other symbols which can be arranged in a line which can be visually perceived as defining a stripe. It will be further appreciated that the presence of limited areas of extraneous indicia, for example a product name or advertising logo, on the exterior surface of the puzzle is within the scope of the current invention provided the otherwise continuous nature of the stripes can be visually perceived.

Figure 5:
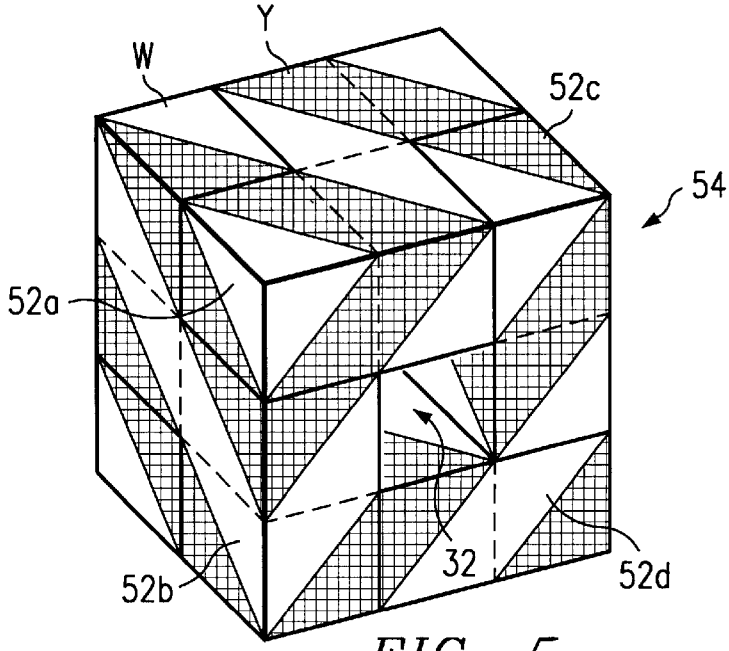
FIG. 5 is a perspective view of a secondary puzzle module, geometrically similar to that shown in FIG. 3, having two different surface indicia defining a pattern of continuous stripes over the external surface according to one aspect of the current invention.
Figure 11:
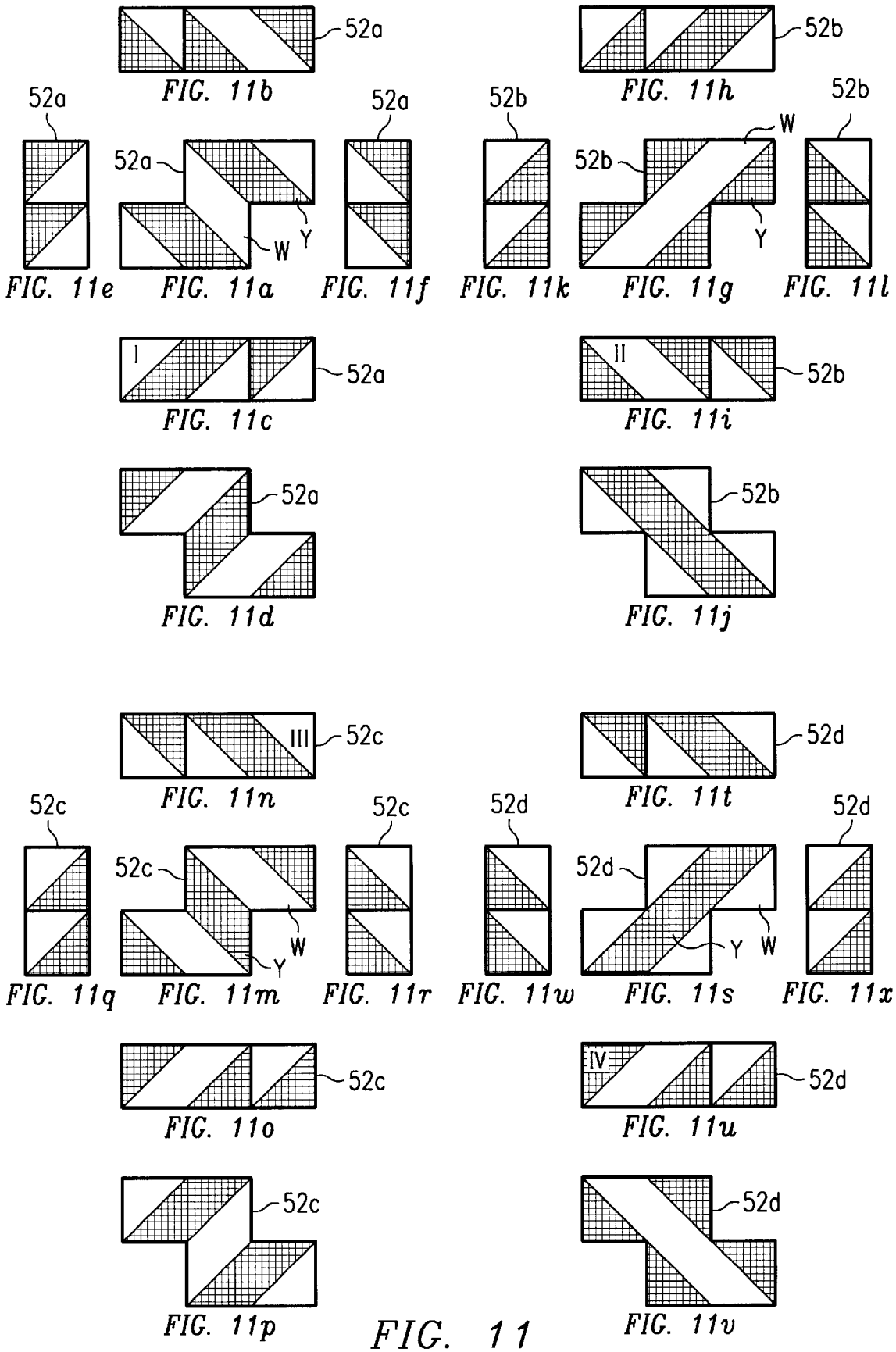
FIGS. 11*a*–11*x* show six orthogonal views for each of four Z-polycube puzzle pieces, denoted I–IV, forming a set having two different surface indicia defining a pattern of continuous stripes over the external surfaces according to a first embodiment of the current invention, namely FIGS. 11*a*–11*f* showing six views of Z-polycube puzzle piece I, FIGS. 11*g*–11*l* showing six views of Z-polycube puzzle piece II, FIGS. 11*m*–11*r* showing six views of Z-polycube puzzle piece III and FIGS. 11*s*–11*x* showing six views of Z-polycube puzzle piece IV.
FIG. 11*y* is a front view of a secondary puzzle module formed by the juxtaposition of the Z-polycube puzzle pieces I–IV shown in FIGS. 11*a*–11*x*.
Figure 11Y:
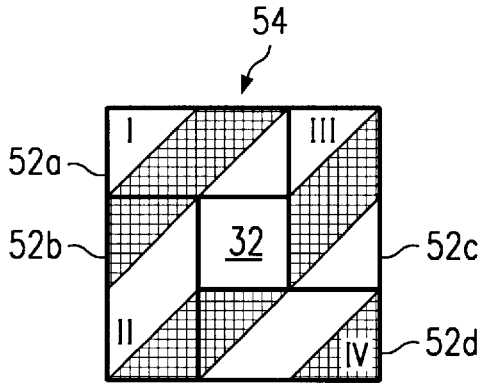

Having now discussed the geometry of Z-polycube puzzle pieces and of a 3×3×2 unit secondary puzzle module which can be created using four identical Z-polycube puzzle pieces, a first aspect of the current invention can be described, where this aspect relates to a set of four Z-polycube puzzle pieces decorated with two or more different surface indicia defining a pattern of continuous stripes on the external surfaces as previously described, wherein the indicia on each Z-polycube puzzle piece in the set is applied in a different pattern, and wherein the four Z-polycube puzzle pieces in the set are juxtaposable as shown in FIG. 2 to form a decorated secondary puzzle module which also defines a pattern of continuous stripes on its external surfaces. Referring now also to FIGS. 5 and 11*a*–11*y*, a first embodiment of this aspect is shown for a set of Z-polycube puzzle pieces decorated with two different surface indicia. Shown in FIGS. 11*a*–11*x* are, respectively, six orthogonal views for each of four decorated Z-polycube puzzle pieces 52*a*–52*d*, each further denoted with an index number I, II, III, or IV, forming a set of Z-polycube puzzle pieces having two different surface indicia (denoted, for purposes of illustration, using reference letters W and Y). Specifically, FIGS. 11*a*–11*f* show six orthogonal views (i.e., first side, top, bottom, second side, first end, and second end, respectively) of the Z-polycube puzzle piece 52*a*, FIGS. 11*g*–11*l* show six orthogonal views of the Z-polycube puzzle piece 52*b*, FIGS. 11*m*–11*r* show six orthogonal views of the Z-polycube puzzle piece 52*c* and FIGS. 11*s*–11*x* show six orthogonal views of the Z-polycube puzzle piece 52*d*. In a preferred embodiment, the indicia W and Y are surface colors (e.g., white and yellow), however, it will be readily apparent that other color combinations or forms of surface indicia can be used as previously described. It will be appreciated from the six orthogonal views of each Z-polycube puzzle piece 52*a*–*d* that the surface indicia W and Y are applied to each Z-polycube puzzle piece to define a pattern of continuous stripes (in this case, diagonal stripes), but the exact pattern of application of the indicia is different for each Z-polycube puzzle piece in the set. Shown in FIG. 11*y* is a front view of a secondary puzzle module 54 formed by the juxtaposition of the set of Z-polycube puzzle pieces 52*a*–*d* (note the relative orientation of the Z-polycube puzzle pieces is shown by the index numbers I–IV). Shown in FIG. 5 is a perspective view of puzzle module 54. It will be readily appreciated (as best seen in FIG. 5) that the two indicia W and Y on secondary puzzle module 54 now define a pattern of continuous stripes over the exterior surface of the puzzle module, including on the faces lining the hole 32 through the middle of the puzzle module. More particularly, the indicia in this case define a pattern of continuous stripes wherein each 3×3 unit side of the puzzle module is decorated with six diagonal stripes and each 3×2 unit side of the puzzle module is decorated with five diagonal stripes.

The embodiment just described becomes a challenging puzzle when the four Z-polycube puzzle pieces 52*a*–*d* are separated from one another and then randomly oriented. One goal of the puzzle can be to juxtapose the four Z-polycube puzzle pieces to form a 3×3×2 unit secondary puzzle module as previously described without regard to the orientation of the indicia. A more challenging goal of the puzzle can be to juxtapose the four Z-polycube puzzle pieces to form a 3×3×2 unit secondary puzzle module 54 having a pattern of continuous stripes on its entire exterior surface. It is important to appreciate that the secondary puzzle module 54 will have a pattern of continuous stripes on its external surfaces only when the four Z-polycube puzzle pieces 52*a*–*d* in the set shown in FIGS. 11*a*–*x* are correctly juxtaposed. Since the Z-polycube puzzle pieces in the set are identical in geometric shape, there are a large number of assembly combinations for the four Z-polycube puzzle pieces which will produce a 3×3×2 rectangular polycube configuration for the secondary puzzle module as shown in FIG. 2. However, most juxtapositions will result in a discontinuous pattern in the stripes on the external surface of the secondary puzzle module 54. This large number of incorrect assembly combinations makes the current invention very desirable as a puzzle to test the ingenuity of the user. Further, once the user has correctly juxtaposed the Z-polycube puzzle pieces 52*a*–*d*, the resulting secondary puzzle module 54 having a pattern of continuous stripes on its external surfaces will become a visually attractive piece of sculpture. Thus, the invention can serve as both a puzzle and a sculpture.

Figure 7:
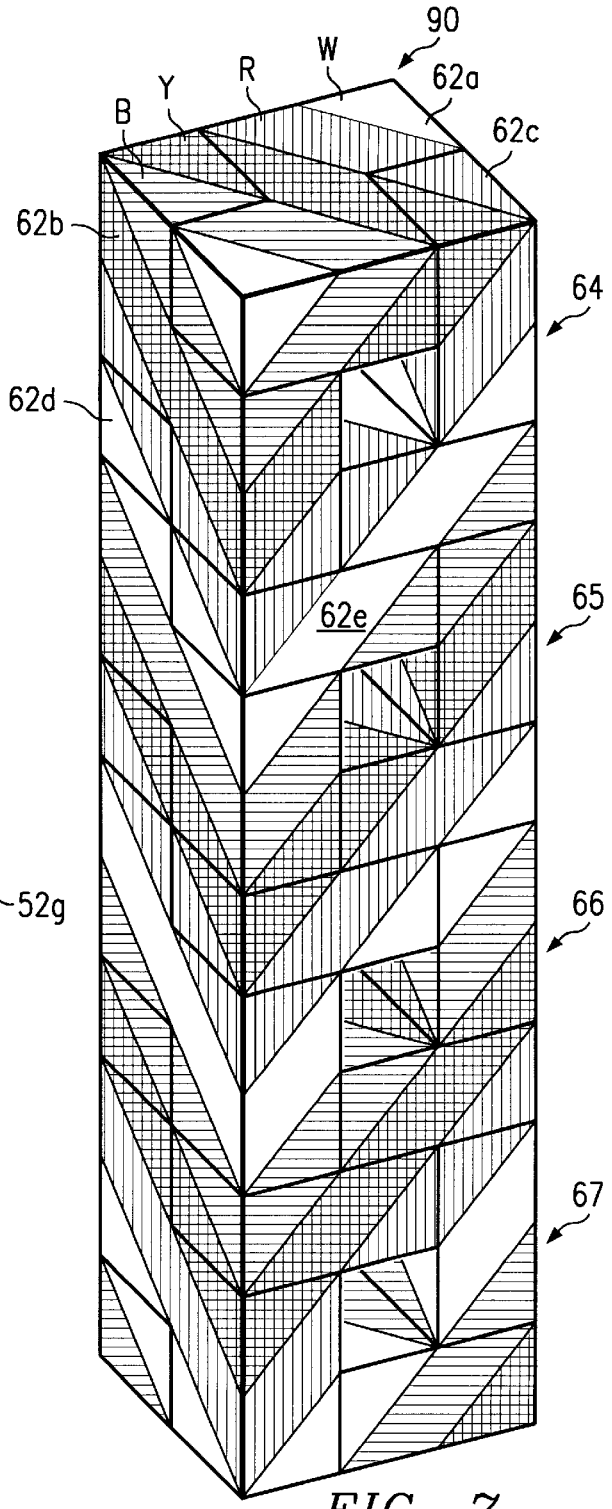
FIG. 7 is a perspective view showing four secondary puzzle modules juxtaposed to form a tertiary puzzle module having four different surface indicia defining a pattern of continuous stripes on the external surface according to another embodiment of the current invention.
Figure 12Y:
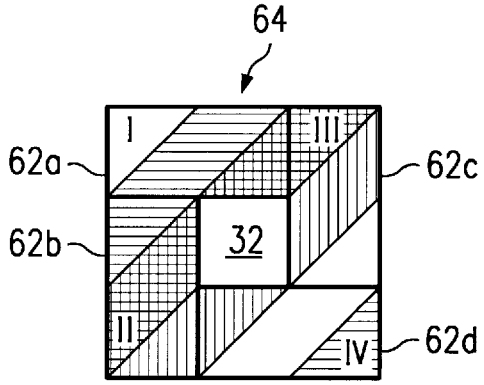
FIG. 12*y* is a front view of a secondary puzzle module formed by the juxtaposition of the Z-polycube puzzle pieces I–IV shown in FIGS. 12*a*–12*x;*

Referring now to FIGS. 12*a*–12*y*, a second embodiment of this aspect comprises a set of Z-polycube puzzle pieces decorated with four different surface indicia. Shown in FIGS. 12*a*–12*x* are, respectively, six orthogonal views for each of four decorated Z-polycube puzzle pieces 62*a*–62*d*, each further denoted with an index number I, II, III, or IV, forming a set of Z-polycube puzzle pieces having four different surface indicia (denoted, for purposes of illustration, using reference letters W, B, Y and R). Specifically, FIGS. 12*a*–12*f* show six orthogonal views of the Z-polycube puzzle piece 62*a*, FIGS. 12*g*–12*l* show six orthogonal views of the Z-polycube puzzle piece 62*b*, FIGS. 12*m*–12*r* show six orthogonal views of the Z-polycube puzzle piece 62*c*, and FIGS. 12*s*–12*x* show six orthogonal views of the Z-polycube puzzle piece 62*d*. In a preferred embodiment, the indicia W, B, Y and R are surface colors (e.g., white, blue, yellow and red), however, it will be readily apparent that other color combinations or forms of surface indicia can be used as previously described. It will be appreciated from the six orthogonal views of each Z-polycube puzzle piece 62 that the surface indicia W, B, Y and R are applied to define a pattern of continuous stripes (in this case, diagonal stripes) on each Z-polycube, but the exact pattern of application of the indicia is different for each Z-polycube puzzle piece in the set. Shown in FIG. 12*y* is a front view of a secondary puzzle module 64 formed by the juxtaposition of the set of Z-polycube puzzle pieces 62*a*–*d* (note the relative orientation of the Z-polycube puzzle pieces is shown by the index numbers I–IV). It will be appreciated (as best seen in FIG. 7) that the four indicia W, B, Y and R on secondary puzzle module 64 now define a pattern of continuous stripes over the exterior surface of the puzzle module, including on the faces lining the hole 32 through the middle of the puzzle module. More particularly, the indicia in this case define a pattern of continuous stripes wherein each 3×3 unit side of the puzzle module is decorated with six diagonal stripes and each 3×2 unit side of the puzzle module is decorated with five diagonal stripes.

Figure 13Y:
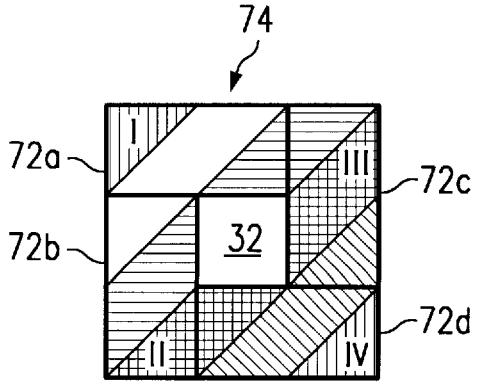
FIG. 13*y* is a front view of a secondary puzzle module formed by the juxtaposition of the Z-polycube puzzle pieces I–IV shown in FIGS. 13*a*–13*x*.
Figure 12:
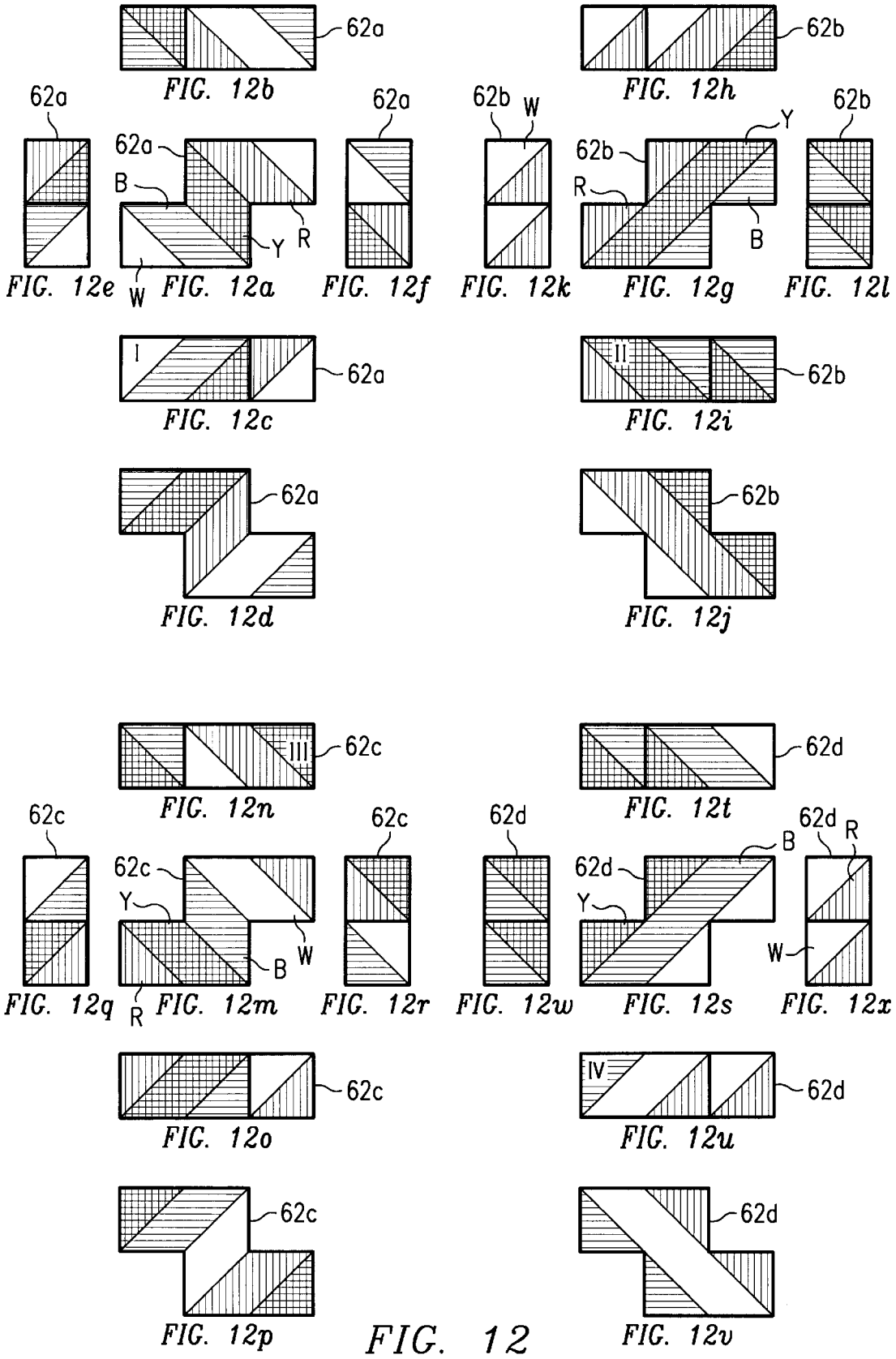
FIGS. 12*a*–12*x* show six orthogonal views for each of four Z-polycube puzzle pieces, denoted I–IV, forming a set having four different surface indicia defining a pattern of continuous stripes over the external surfaces according to a second embodiment of the current invention, namely FIGS. 12*a*–12*f* showing six views of Z-polycube puzzle piece I, FIGS. 12*g*–12*l* showing six views of Z-polycube puzzle piece II, FIGS. 12*m*–12*r* showing six views of Z-polycube puzzle piece III and FIGS. 12*s*–12*x* showing six views of Z-polycube puzzle piece IV.
Figure 13:
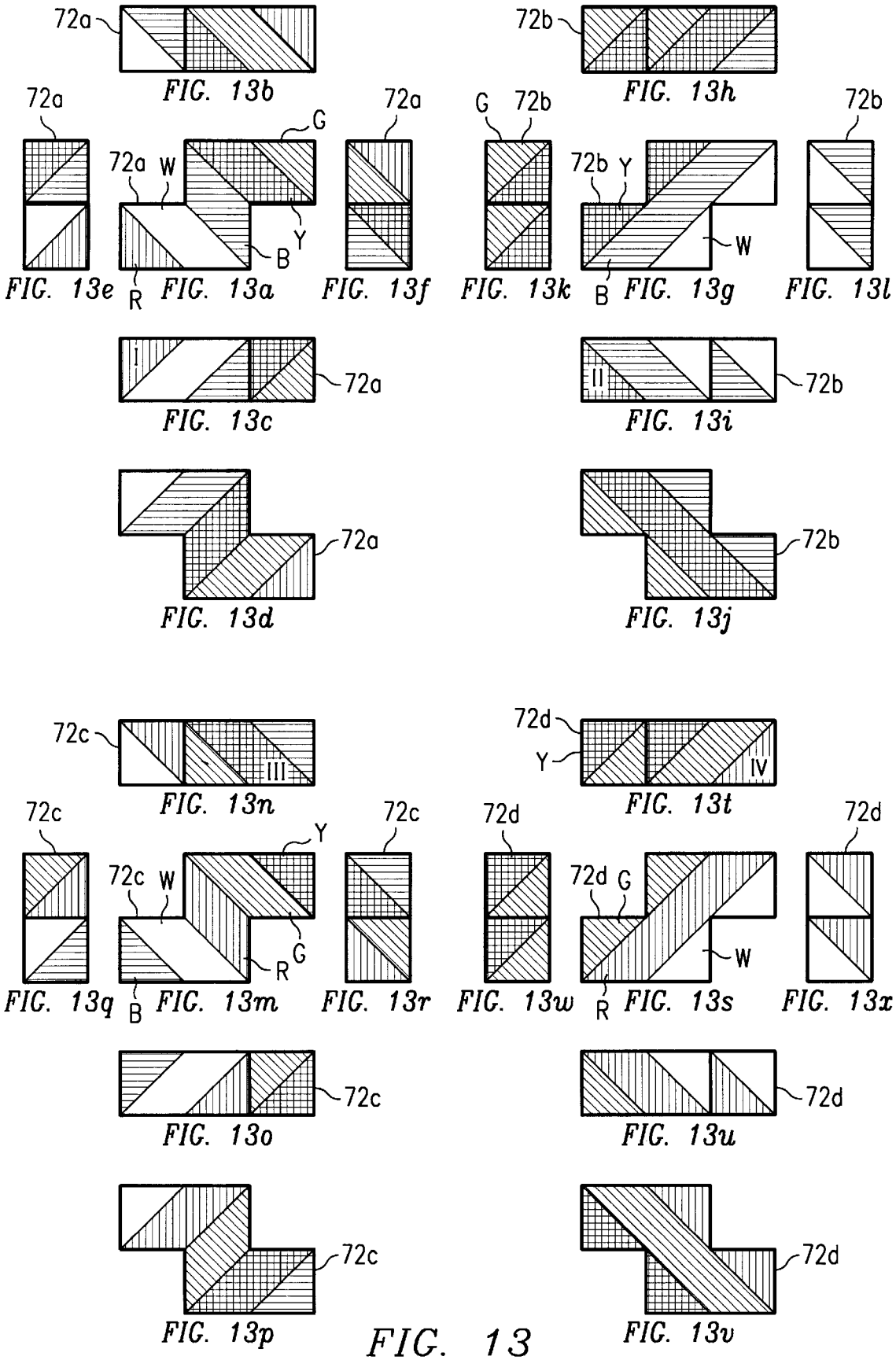
FIGS. 13*a*–13*x* show six orthogonal views for each of four Z-polycube puzzle pieces, denoted I–IV, forming a set having five different surface indicia defining a pattern of continuous stripes over the external surfaces according to a third embodiment of the current invention, namely FIGS. 13*a*–13*f* showing six views of Z-polycube puzzle piece I, FIGS. 13*g*–13*l* showing six views of Z-polycube puzzle piece II, FIGS. 13*m*–13*r* showing six views of Z-polycube puzzle piece III and FIGS. 13*s*–13*x* showing six views of Z-polycube puzzle piece IV.

Referring now to FIGS. 13*a*–13*y*, yet another embodiment of this aspect comprises a set of Z-polycube puzzle pieces decorated with five different surface indicia. Shown in FIGS. 13*a*–13*x* are, respectively, six orthogonal views for each of four decorated Z-polycube puzzle pieces 72*a*–72*d*, each further denoted with an index number I, II, III, or IV, forming a set of Z-polycube puzzle pieces having five different surface indicia (denoted, for purposes of illustration, using reference letters R, W, B, Y and G). Specifically, FIGS. 13*a*–13*f* show six orthogonal views of the Z-polycube puzzle piece 72*a*, FIGS. 13*g*–13*l* show six orthogonal views of the Z-polycube puzzle piece 72*b*, FIGS. 13*m*–13*r* show six orthogonal views of the Z-polycube puzzle piece 72*c*, and FIGS. 13*s*–13*x* show six orthogonal views of the Z-polycube puzzle piece 72*d*. In the preferred embodiment, the indicia R, W, B, Y and G are surface colors (e.g., red, white, blue, yellow and green), however, it will be readily apparent that other color combinations or forms of surface indicia can be used as previously described. It will be appreciated from the six orthogonal views of each Z-polycube puzzle piece 72 that the surface indicia R, W, B, Y and G are applied to define a pattern of continuous stripes (in this case, diagonal stripes) on each Z-polycube, but the exact pattern of application of the indicia is different for each Z-polycube puzzle piece in the set. It will be further appreciated that, in this embodiment, some of the Z-polycube puzzle pieces in the set will be decorated with all five of the five different indicia (e.g., Z-polycube puzzle pieces 72*a* and 72*c*), whereas other Z-polycube puzzle pieces will be decorated with a lesser number of the five indicia types (e.g., Z-polycube puzzle pieces 72*b* and 72*d*) in order to produce the desired result. Shown in FIG. 13*y* is a front view of a secondary puzzle module 74 formed by the juxtaposition of the set of Z-polycube puzzle pieces 72*a*–*d* (note the relative orientation of the Z-polycube puzzle pieces is shown by the index numbers I–IV). It will be readily appreciated (e.g., in FIGS. 8, 9 or 10) that the five indicia types R, W, B, Y and G on secondary puzzle module 74 now define a pattern of continuous stripes over the exterior surface of the puzzle module, including on the faces lining the hole 32 through the middle of the puzzle module. More particularly, the indicia in this case define a pattern of continuous stripes wherein each 3×3 unit side of the puzzle module is decorated with six diagonal stripes and each 3×2 unit side of the puzzle module is decorated with five diagonal stripes.

While three preferred embodiments of the current invention have been described in detail herein, i.e., puzzles comprising sets of four Z-polycube puzzle pieces juxtaposable to form secondary modules having two, four, and five different surface indicia, respectively, visible on the external surfaces defining patterns of continuous diagonal stripes, it will be readily apparent that additional embodiments having different numbers of visible surface indica are within the scope of the current invention. For example, puzzles similar to those described above but having three, six, seven and eight different indicia can readily be constructed using the principles and techniques disclosed herein. Still other embodiments utilizing different shaped pieces, different numbers of indicia, and different patterns of indicia arrangement also lie within the scope of the current invention.

Yet another aspect of the current invention relates to a puzzle comprising two or more sets of Z-polycube pieces as described above, the external shape and size of all the pieces in all of the sets being identical, wherein each set is juxtaposable to create a secondary puzzle module having two or more different indicia visible on the external surface defining patterns of continuous stripes, and further wherein the secondary puzzle modules are juxtaposable to create a tertiary object having two or more different indicia visible on the external surface defining a pattern of continuous stripes.

Figure 6:
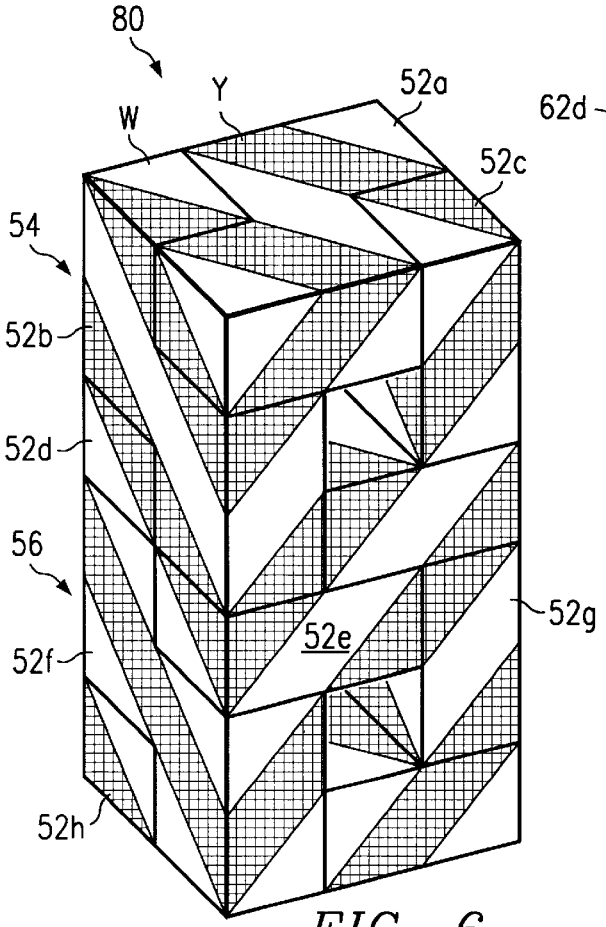
FIG. 6 is a perspective view showing two secondary puzzle modules juxtaposed to form a tertiary structure having two different surface indicia defining a pattern of continuous stripes over the external surface according to another aspect of the current invention.

Referring now to FIG. 6, a puzzle 80 constituting a first embodiment of this aspect is shown. The puzzle 80 comprises two secondary puzzle modules 54 and 56 juxtaposed to create a tertiary object or puzzle module. Two different indicia (denoted with reference letters W and Y) are present on the external surface of puzzle 80, and these indicia can define a pattern of continuous stripes for the entire tertiary module as shown in FIG. 6. It will be appreciated that FIG. 6 shows only one possible juxtaposition of the two puzzle modules 54 and 56, and that other configurations of the puzzle 80 can be produced by differently juxtaposing the puzzle modules 54, 56 such that any two 3×2 unit plane surfaces are adjacent (as in FIG. 6) or such that any two 3×3 unit plane surfaces (each with a square center hole) are adjacent (not shown). Of these alternative juxtapositions, only a limited number can define a pattern of continuous stripes of the two indicia over the external surface of the tertiary module 80, whereas most juxtapositions will produce a discontinuous pattern. Thus, the user of the puzzle is challenged to find all possible juxtapositions of the two puzzle modules 54, 56 creating a pattern of continuous stripes on the external surfaces of the tertiary module.

As previously described, the two secondary puzzle modules, 54 and 56, of the puzzle 80 each consist of a set of four pieces (denoted 52*a–d* and 52*e–h*, respectively). All of the pieces in all of the sets have the identical geometric shape and size, and all of the pieces in all of the sets have two different indicia arranged to define patterns of continuous stripes over their external surfaces. It is important to appreciate, however, that the indicia are applied on the pieces 52*a–h* such that the patterns of indicia are different for each set of pieces, not merely for the pieces within a single set. Thus, none of the pieces 52*a–d* forming the secondary puzzle module 54 has the same pattern of indicia (e.g., identical placement of identical indicia) as any of the pieces 52*e–h* forming the secondary puzzle module 56.

Referring again to FIGS. 11*a–x*, further details of this aspect of the invention can now be described. The arrangement of indicia used for the first set of four pieces 52*a–d* which can form the first secondary puzzle module 54 was previously discussed and is shown in FIGS. 11*a–x*. The arrangement of indicia for a second set of four pieces 52*e–h* which can form the second secondary puzzle module 56 (needed for the puzzle 80) can be determined using the indicia layout shown in FIGS. 11*a–x* in conjunction with the transformations set forth in Table 1 as follows:

TABLE 1

Indicia Values for Two Puzzle module/Two Indicia Type Puzzle

| | Puzzle module No. | |
|---|---|---|
| Indicia Location No. | 1 | 2 |
| 1st Locations | Y | W |
| 2nd Locations | W | Y |

Table 1 provides indicia values for designated indicia locations on the four pieces (e.g., Z-polycube puzzle pieces 52*a–d*) constituting a set of pieces forming a secondary puzzle module (e.g., puzzle module 54). The indica values in Table 1 are merely arbitrary designations distinguishing between the different indicia types used in the puzzle, and thus may represent surface colors, patterns, etc. as previously described. Further, Table 1 provides only relative transformations, and thus must be used in conjunction with a layout (e.g., FIGS. 11*a–x*) showing the placement of indicia types for all four pieces constituting one secondary puzzle module (typically designated puzzle module number 1).

To use Table 1, a user first uses the column for puzzle module number 1 to define indicia locations on the layout diagram (e.g., FIGS. 11*a–x*) of the four pieces (e.g., Z-polycube puzzle pieces 52*a–x*) for puzzle module number 1. This is done by simply defining all regions having the same indicia value as given for puzzle module number 1, 1st location (e.g., "Y" in Table 1) as being "1st locations" and all regions having the same indica value as given for puzzle module number 1, 2nd location (e.g., "W" in Table 1) as being "2nd locations". It is important to appreciate that this location designation is fixed by the puzzle module number 1 values and does not change for other puzzle modules. Next, the indicia layout for next set of four pieces (e.g., Z-polycube puzzle pieces 52*e–g*) for puzzle module number 2 can be determined by replacing the indicia values shown on the original layout diagram with the indicia values for the appropriate indicia locations given in the puzzle module 2 column of Table 1. For example, applying Table 1 to the piece 52*a* shown in FIG. 11*a–x* will yield new piece 52*e* (best seen in FIG. 6), wherein for each region of piece 52*a* which has indicia value "W", piece 52*e* will have a like region which has indicia value "Y", and for each region on piece 52*a* which has indicia value "Y", piece 52*e* will have a like region which has indicia value "W". Similarly applying the transformations of Table 1 to the remaining pieces 52*b–d* will yield new pieces 52*f–h* forming a second secondary puzzle module 56 as shown in FIG. 6.

Just as the first aspect of the current invention could be extended from sets forming secondary puzzle modules having two different indicia to sets having four or more different indicia, the second aspect can be similarly extended. For example, referring now to FIG. 7, a puzzle 90 constituting a second embodiment of this aspect is shown. The puzzle 90 comprises four secondary puzzle modules 64, 65, 66 and 67 juxtaposed to create a tertiary object or puzzle module. Four different indicia (denoted with reference letters W, B, Y, and R) are present on the external surface of puzzle 90, and these indicia can define a pattern of continuous stripes as shown in FIG. 7. It will be appreciated that FIG. 7 shows only one possible juxtaposition of the four puzzle modules 64, 65, 66 and 67, and that other configurations of the puzzle 90 can be produced by differently juxtaposing the puzzle modules 64, 65, 66 and 67 such that any two 3×2 unit cube surfaces are adjacent (as in FIG. 7) or such that any two 3×3 unit cube surfaces (each with a square center hole) are adjacent (not shown). Of these alternative juxtapositions, a limited number can produce a pattern of continuous stripes of the four indicia over the external surface of the tertiary module, but most will produce a discontinuous pattern. Thus, the user of the puzzle is challenged to find all possible juxtapositions of the four puzzle modules 64, 65, 66 and 67 creating a pattern of continuous stripes on the external surfaces of the tertiary module.

As with the previous embodiment, the secondary puzzle modules, 64, 65, 66 and 67 of the puzzle 90 each consist of a set of four pieces. All of the pieces in all of the sets have the identical geometric shape and size, and all of the pieces in all of the sets have four different indicia arranged to define patterns of continuous stripes over their external surfaces. It is important to appreciate, however, that the indicia are applied on the pieces such that the patterns of indicia are different for each set of pieces, not merely for the pieces within a single set. Thus, none of the pieces forming the secondary puzzle module 64 has the same pattern of indicia (i.e., identical placement of identical indicia) as any of the pieces forming the secondary puzzle modules 65, 66 or 67. If the user disassembles the individual puzzle modules of the puzzle and intermixes the sixteen identically shaped and sized Z-polycube puzzle pieces, it will present a significant challenge to assemble the pieces back into the juxtapositions to obtain the original puzzle modules or more complex tertiary configurations having a pattern of continuous stripes as shown in FIG. 7.

Referring again to FIGS. 12*a–x*, further details of this aspect of the invention can now be described. The arrangement of indicia used for the first set of four pieces 62*a–d* which can form the first secondary puzzle module 64 was previously discussed and is shown in FIGS. 12*a–d*. The arrangement of indicia for a second, third, and fourth sets of four pieces which can form the second, third and fourth secondary puzzle modules 65, 66 and 67, respectively (needed for the puzzle 90) can be determined using the indicia layout shown in FIGS. 12*a–x* in conjunction with the transformations set forth in Table 2 as follows:

TABLE 2

Transformations for Four Puzzle module/Four Indicia Type Puzzle

| | Puzzle module No. | | | |
|---|---|---|---|---|
| Indicia Location No. | 1 | 2 | 3 | 4 |
| 1st Indicia | R | Y | B | W |
| 2nd Indicia | W | R | Y | B |
| 3d Indicia | B | W | R | Y |
| 4th Indicia | Y | B | W | R |

Table 2 provides indicia values for designated indicia locations on the four pieces (e.g., Z-polycube puzzle pieces 62*a–d*) constituting a set of pieces forming a secondary puzzle module (e.g., puzzle module 64). Table 2 is used in a similar fashion as described for Table 1, providing relative transformations which must be used in conjunction with a layout (e.g., FIGS. 12*a–x*) showing the placement of indicia types for all four pieces constituting one secondary puzzle module (typically designated puzzle module number 1).

To use Table 2, a user first uses the column for puzzle module number 1 to define indicia locations on the layout diagram (e.g., FIGS. 12*a–x*) of the four pieces (e.g., Z-polycube puzzle pieces 62*a–d*) for puzzle module number 1 as previously described for Table 1 (except that four indicia locations will now be defined). Next, the indicia layout for the other sets of four pieces (e.g., for secondary puzzle modules 65, 66, and 67 in FIG. 7) can be determined by replacing the indicia values shown on the original layout diagram with the indicia values for the appropriate indicia locations given in the puzzle module 2, 3 or 4 column of Table 2, respectively. For example, applying Table 2 to the piece 62*a* shown in FIG. 12*a* will yield a new piece 62*e* (FIG. 7), wherein for each region of piece 62*a* which has indicia value "R", piece 62*e* will have a like region which has indicia value "Y", for each region on piece 62*a* which has indicia value "W", piece 62*e* will have a like region which has indicia value "R", for each region of piece 62*a* which has indicia value "B", piece 62*e* will have a like region which has indicia value "W", and for each region on piece 62*a* which has indicia value "Y", piece 62*e* will have a like region which has indicia value "B". Similarly applying the transformations of Table 2, column 2 to the remaining pieces of the second puzzle module will yield the remaining pieces needed to form a second secondary puzzle module 65 as shown in FIG. 7. Similarly applying the transformations of Table 2, columns 3 and 4 to the indicia layout in FIGS. 12*a–x* will yield new sets of pieces forming secondary puzzle modules 66 and 67 as shown in FIG. 7. It should be noted, however, that the transformations are always based on the indicia locations defined by puzzle module number 1, thus, for example the transformation for 1st indicia on puzzle module 3 will be to replace each region on piece 62*a* (from puzzle module number 1) which has indicia value "R" with a like region which has indicia value "B".

Figure 8:
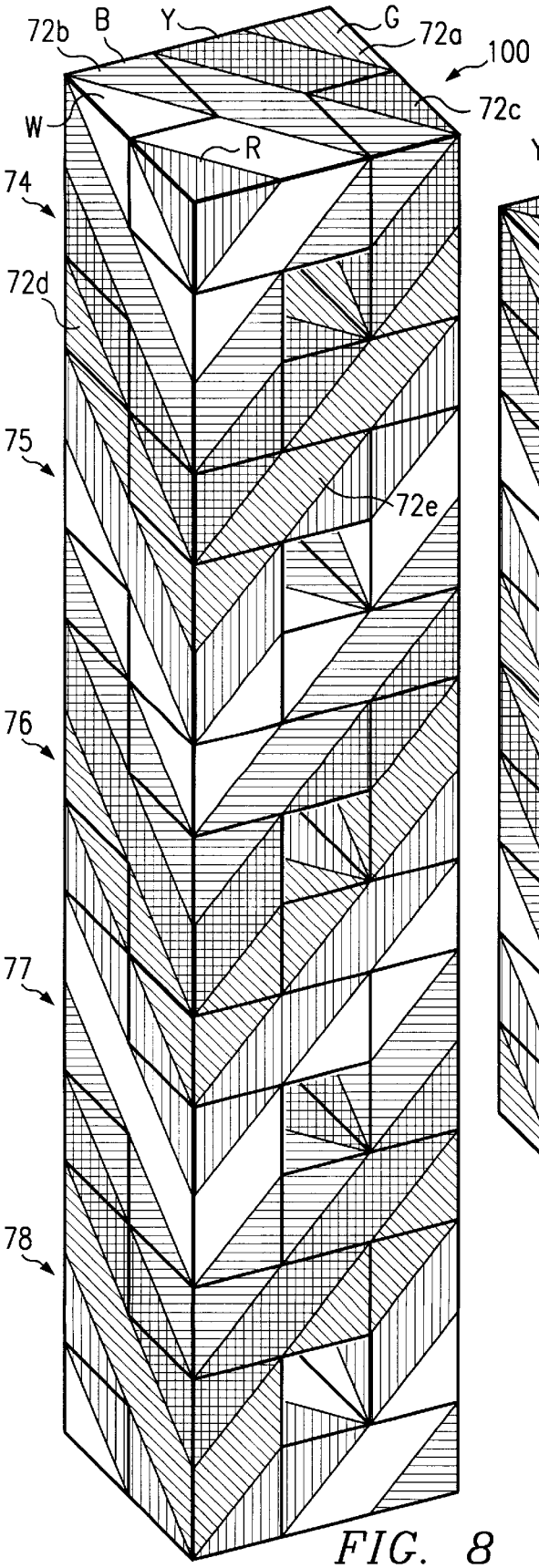
FIG. 8 is a perspective view showing five secondary puzzle modules juxtaposed to form a tertiary puzzle module having five different surface indicia defining a pattern of continuous stripes over the external surface according to yet another embodiment of the current invention.
Figure 9:
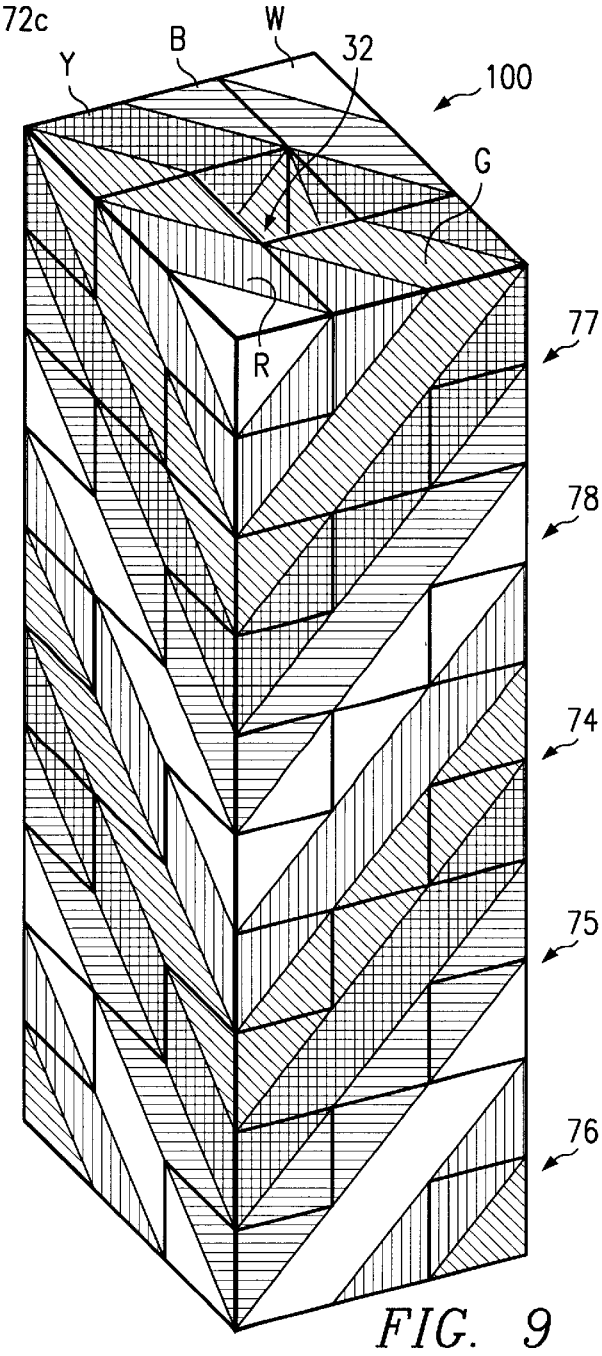
FIG. 9 is a perspective view showing an alternative juxtaposition of the five secondary puzzle modules of FIG. 8 to form another tertiary puzzle module having five different surface indicia defining a pattern of continuous stripes over the external surface.
Figure 10:
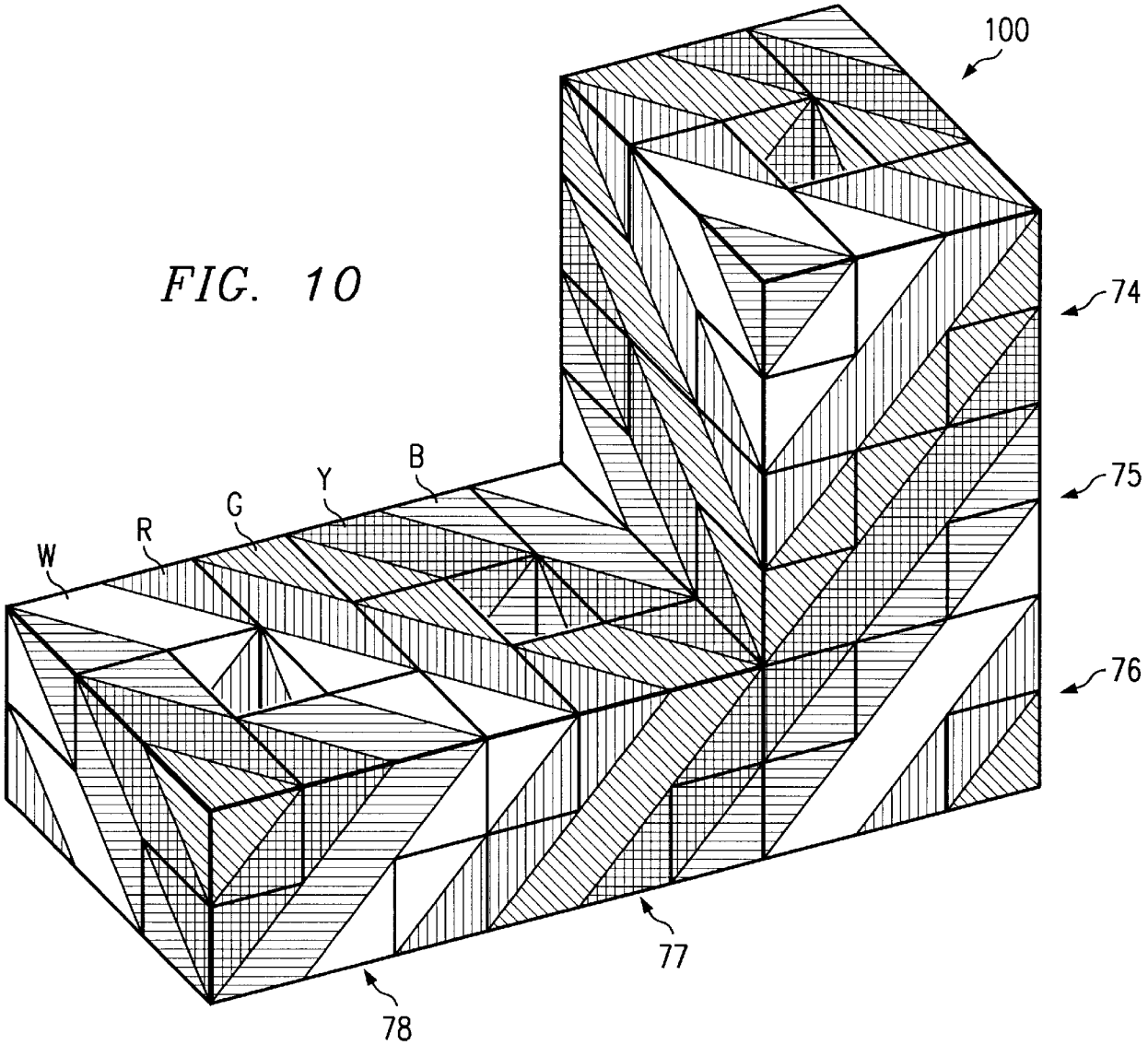
FIG. 10 is a perspective view showing yet another alternative juxtaposition of the five secondary puzzle modules of FIG. 8 to form yet another tertiary puzzle module having five different surface indicia defining a pattern of continuous stripes over the external surface.

Referring now to FIGS. 8–10, a puzzle 100 constituting yet another embodiment of this aspect is shown. The puzzle 100 comprises five secondary puzzle modules 74, 75, 76, 77 and 78 juxtaposed to create a tertiary object or puzzle module. Five different indicia (denoted with reference letters R, W, B, Y, and G) are present on the external surface of puzzle 100, and these indicia can define patterns of continuous stripes as shown in FIGS. 8–10. It will be appreciated that FIG. 8 shows one possible juxtaposition of the puzzle modules 74, 75, 76, 77 and 78 having the 3×2 unit cube surfaces adjacent, FIG. 9 shows another possible juxtaposition of the puzzle modules 74, 75, 76, 77 and 78 having the 3×3 unit cube surfaces adjacent (and with the center hole 32 running through the entire assembly), and FIG. 10 shows yet another possible juxtaposition of the same puzzle modules 74, 75, 76, 77 and 78 wherein some of the 3×2 unit cube surfaces are adjacent and some of the 3×3 unit cube surfaces are adjacent. While each of the alternative juxtapositions shown in FIGS. 8–10 have the indicia on the external surfaces forming a pattern of continuous stripes, only a limited number of juxtapositions can produce this result, most will instead produce a discontinuous pattern. Thus, the user of the puzzle is challenged to find all possible juxtapositions of the five puzzle modules 74, 75, 76, 77 and 78 definiing patterns of continuous stripes on the external surfaces of tertiary puzzle modules.

As with the previous embodiment, the secondary puzzle modules, 74, 75, 76, 77 and 78 of the puzzle 100 each consist of a set of four pieces. All of the pieces in all of the sets have the identical geometric shape and size, and all of the pieces in all of the sets have indicia arranged to define patterns of continuous stripes over their external surfaces. In this embodiment, however, each of the pieces need not be decorated with all five of the different indicia present on the secondary puzzle module, but instead each piece will have either four or five different indicia. It is important to appreciate, however, that the indicia are still applied on the pieces such that the patterns of indicia are different for each set of pieces, not merely for the pieces within a single set. Thus, none of the pieces forming the secondary puzzle module 74 has the same pattern of indicia (i.e., identical placement of identical indicia) as any of the pieces forming the secondary puzzle modules 75, 76, 77 or 78. In addition, if the user disassembles the individual puzzle modules of the puzzle and intermixes the twenty identically shaped and sized Z-polycube puzzle pieces, it will present a significant challenge to assemble the pieces back into the juxtapositions to obtain the configurations shown in FIGS. 8–10.

Referring again to FIGS. 13*a–x*, further details of this aspect of the invention can now be described. The arrangement of indicia used for the first set of four pieces 72*a–d* which can form the first secondary puzzle module 74 was previously discussed and is shown in FIGS. 13*a–x*. The arrangement of indicia for a second, third, fourth and fifth sets of four pieces which can form the second, third, fourth and fifth secondary puzzle modules, 75, 76, 77 and 78, respectively (needed for the puzzle 100) can be determined using the indicia layout shown in FIGS. 13*a–x* in conjunction with the transformations set forth in Table 3 as follows:

TABLE 3

Transformations for Five Puzzle module/Five Indicia Type Puzzle

| | Puzzle module No. | | | | |
|---|---|---|---|---|---|
| Indicia Location No. | 1 | 2 | 3 | 4 | 5 |
| 1st Indicia | R | Y | W | G | B |
| 2nd Indicia | W | G | B | R | Y |
| 3d Indicia | B | R | Y | W | G |
| 4th Indicia | Y | W | G | B | R |
| 5th Indicia | G | B | R | Y | W |

Table 3 provides indicia values for designated indicia locations on the four pieces (e.g., Z-polycube puzzle pieces 72*a–d*) constituting a set of pieces forming a secondary puzzle module (e.g., puzzle module 74). Table 3 is used in a similar fashion as described for Tables 1 and 2, providing relative transformations which must be used in conjunction with a layout (e.g., FIGS. 13*a–x*) showing the placement of indicia types for all four pieces constituting one secondary puzzle module (typically designated puzzle module number 1). To use Table 3, a user first uses the column for puzzle module number 1 to define indicia locations on the layout diagram (e.g., FIGS. 13*a–x*) of the four pieces (e.g., Z-polycube puzzle pieces 72*a–d*) for puzzle module number 1 as previously described for Tables 1 and 2 (except that five indicia locations will now be defined). Next, the indicia layout for the other sets of four pieces (e.g., for secondary puzzle modules 75, 76, 77 and 78) can be determined by replacing the indicia values shown on the original layout diagram with the indicia values for the appropriate indicia locations given in the puzzle module 2, 3, 4 or 5 column of Table 3, respectively. The use of Table 3 is otherwise similar to the tables previously described, and thus further examples are not required.

While several more preferred embodiments of the current invention have been described in detail herein, i.e., puzzles comprising two, four and five sets, respectively, of four Z-polycube puzzle pieces, where each set is juxtaposable to form a secondary puzzle module and where multiple secondary puzzle modules can, in turn, be juxtaposed to form tertiary puzzle modules, and where the secondary modules and tertiary modules are all capable of defining patterns of continuous diagonal stripes on the external surfaces, it will be readily apparent that additional embodiments having different numbers of sets of puzzle pieces or different numbers of different indicia can readily be constructed using the principles and techniques disclosed herein and thus also lie within the scope of the current invention.

Thus, there is disclosed a three-dimensional modular puzzle that presents a desirable challenge to the ingenuity of the user and which becomes an attractive piece of sculpture when juxtaposed such that the indicia form a pattern of continuous stripes on its external surface. While the foregoing embodiments of the invention have been disclosed with reference to a specific puzzle structure, it is to be understood that many changes in detail may be made as a matter of design choices, without departing from the spirit and scope of the invention, as defined by the appended claims.

I claim:

1. A three-dimensional puzzle comprising:

a plurality of puzzle pieces wherein each of said puzzle pieces has the shape of a Z-polycube formed from four unit cubes, each said puzzle piece having at least two different indicia applied on the external surfaces thereof to define a pattern of visibly continuous stripes thereon; and said plurality of puzzle pieces being juxtaposable to form a secondary puzzle module having at least two of said different indicia visible on the external surfaces thereof defining a pattern of visibly continuous stripes thereon.

2. A three-dimensional puzzle according to claim 1, wherein said secondary puzzle module has at least four different indicia visible on said external surface.

3. A three-dimensional puzzle according to claim 2, wherein said secondary puzzle module has at least five different indicia visible on said external surface.

4. A three-dimensional puzzle according to claim 1, wherein at least one of said indicia is a surface color.

5. A three-dimensional puzzle according to claim 1, wherein at least one of said indicia is a surface texture.

6. A three-dimensional puzzle according to claim 1, said puzzle consisting of four puzzle pieces.

7. A three-dimensional puzzle according to claim 6, wherein said secondary puzzle module comprises a polycube solid having orthogonal exterior dimensions of three units, three units, and two units, respectively, and forming a passage therethrough having orthogonal dimensions of one unit, one unit, and two units, respectively.

8. A three-dimensional puzzle according to claim 7, wherein said pattern of visibly continuous stripes on said secondary module includes stripes on the exposed surface of said passage.

9. A three-dimensional puzzle according to claim 7, wherein said pattern of visibly continuous stripes on said secondary module consists of six stripes running diagonally across each plane surface having exterior dimensions of three units by three units and five stripes running diagonally across each plane surface having exterior dimensions of three units by two units.

10. A three-dimensional puzzle consisting of four puzzle pieces, each said puzzle piece being of an identical size, having the shape of a Z-polycube formed from four unit cubes and having at least two different indicia applied on the external surfaces thereof to define a pattern of visibly continuous stripes thereon;

said puzzle pieces being juxtaposable to form a secondary puzzle module having the shape of a polycube solid with orthogonal exterior dimensions of three units, three units, and two units, respectively, and forming a passage therethrough having orthogonal dimensions of one unit, one unit, and two units, respectively, and having at least two of said different indicia visible on the external surfaces thereof defining a pattern of visibly continuous stripes thereon.

11. A three-dimensional puzzle according to claim 10, wherein said pattern of visibly continuous stripes on said secondary module includes stripes on the exposed surface of said passage.

12. A three-dimensional puzzle according to claim 10, wherein each of said different indicia is an indicia selected from the group consisting of surface colors, surface textures, letters formed on the surface, numbers formed on the surface, symbols formed on the surface, and icons formed on the surface.

13. A three-dimensional puzzle according to claim 10, wherein said pattern of visibly continuous stripes on said secondary module consists of six stripes running diagonally across each plane surface having exterior dimensions of three units by three units and five stripes running diagonally across each plane surface having exterior dimensions of three units by two units.

14. A three-dimensional puzzle according to claim 13, wherein said different indicia defining a pattern of visibly continuous stripes on said secondary puzzle module are two contrasting surface colors.

15. A three-dimensional puzzle according to claim 13, wherein said different indicia defining a pattern of visibly continuous stripes on said secondary puzzle module are three contrasting surface colors.

16. A three-dimensional puzzle according to claim 13, wherein said different indicia defining a pattern of visibly continuous stripes on said secondary puzzle module are four contrasting surface colors.

17. A three-dimensional puzzle according to claim 13, wherein said different indicia defining a pattern of visibly continuous stripes on said secondary puzzle module are five contrasting surface colors.

18. A three-dimensional puzzle according to claim 13, wherein said different indicia defining a pattern of visibly continuous stripes on said secondary puzzle module are six contrasting surface colors.

19. A three-dimensional puzzle according to claim 13, wherein said different indicia defining a pattern of visibly continuous stripes on said secondary puzzle module are at least seven contrasting surface colors.

20. A three-dimensional puzzle comprising:

at least two sets of puzzle pieces;

each said set having a like number of puzzle pieces, all said puzzle pieces in all said sets being of identical size and shape and having at least two different indicia applied on the external surfaces thereof to define a pattern of continuous stripes thereon, said pattern of continuous stripes being different on each said piece of all said sets;

said puzzle pieces of each set being juxtaposable to form a secondary puzzle module having at least two of said different indicia visible on the external surfaces thereof and defining a pattern of continuous stripes thereon;

said secondary puzzle modules being juxtaposable to form a tertiary puzzle module having at least two different indicia visible on the external surfaces thereof forming a pattern of continuous stripes thereon.

21. A three-dimensional puzzle according to claim 20, comprising at least four sets of puzzle pieces and having at least four different indicia visible on the external surfaces of said puzzle pieces, said secondary puzzle modules, and said tertiary puzzle module.

22. A three-dimensional puzzle according to claim 21, comprising at least five sets of puzzle pieces and having at least five different indicia visible on said external surfaces of said secondary puzzle modules and said tertiary puzzle module.

23. A three-dimensional puzzle according to claim 20, wherein said puzzle pieces are polycubes.

24. A three-dimensional puzzle according to claim 20, wherein each said set consists of four puzzle pieces, each said puzzle piece being in the shape of a Z-polycube formed from four unit cubes.

25. A three-dimensional puzzle according to claim 24, wherein each said secondary puzzle module has a polycube shape with orthogonal exterior dimensions of three units, three units, and two units, respectively, and forming a passage therethrough having orthogonal interior dimensions of one unit, one unit, and two units, respectively.

26. A three-dimensional puzzle according to claim 25, wherein said tertiary puzzle module comprises at least two said secondary puzzle modules juxtaposed at sides each having dimensions of three units by three units.

27. A three-dimensional puzzle according to claim 25, wherein said tertiary puzzle module comprises at least two said secondary puzzle modules juxtaposed at sides each having dimensions of three units by two units.

* * * * *

UNITED STATES PATENT AND TRADEMARK OFFICE

CERTIFICATE OF CORRECTION

PATENT NO. : 6,196,544 B1
DATED : March 6, 2001
INVENTOR(S) : Morton Rachofsky

It is certified that error appears in the above-identified patent and that said Letters Patent is hereby corrected as shown below:

Column 10,
Line 47, delete "52e-g", and insert-- 52e-h-- .

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*